US005538287A

United States Patent [19]

Ozeki

[11] Patent Number: 5,538,287

[45] Date of Patent: Jul. 23, 1996

[54] BINDER FOR FILE SHEETS

[75] Inventor: Jiro Ozeki, Tokyo, Japan

[73] Assignee: Slidex Corporation, Tokyo, Japan

[21] Appl. No.: 350,200

[22] Filed: Dec. 5, 1994

[30] Foreign Application Priority Data

Dec. 14, 1993 [JP] Japan ..... 5-313496

[51] Int. Cl.[6] ..... B42D 1/00

[52] U.S. Cl. ..... 281/21.1; 281/15.1; 281/36

[58] Field of Search ..... 281/21.1, 15.1, 281/36, 51, 29; 402/8

[56] References Cited

U.S. PATENT DOCUMENTS 5,104,147 4/1992 King ..... 281/21.1

5,441,308 8/1995 Nishikawa ..... 281/21.1

FOREIGN PATENT DOCUMENTS 62-125339 6/1987 Japan .

3-218899 9/1991 Japan .

*Primary Examiner*—Willmon Fridie, Jr.

*Attorney, Agent, or Firm*—Keck, Mahin & Cate

[57] ABSTRACT

A file sheet binder including a plurality of binding units arranged in parallel. Each of the binding units comprises a flat, elongated base plate and one or more gripping sections, each including a pair of gripping members provided at one surface of the base plate. The paired gripping members have edges which are opposed to each other to form a slit therebetween so that a file sheet can be gripped at an edge portion by the edges forming the slit. An opening is formed in the base plate between the paired gripping members. The gripping members and the base plate are manufactured as an integral part by molding a plastics material. The opening is adapted for removing a core which is used in molding process for defining a space between the paired gripping members.

12 Claims, 6 Drawing Sheets

BINDER FOR FILE SHEETS

BACKGROUND OF THE INVENTION

1. Field of the Invention

The present invention relates to a binder for a file sheet. More particularly, the present invention pertains to a binder for detachably binding file sheets adapted for storing recording medium of thin configuration.

2. Description of the Prior Art

The Japanese Patent Disclosure No. Sho 62-125339 discloses a file sheet which is adapted to store one or more thin sheets of recording medium, such as a floppy disc or a compact disc (CD). The U.S. Pat. No. 5,037,137 which corresponds to the Japanese Patent Disclosure No. Hei 3-218899 discloses several types of binders adapted for detachably binding such file sheets. Typically, the binder disclosed by the aforementioned U.S. patent comprises an elongated gripping member made of a resilient material, such as a plastics material. The gripping member has a groove provided with a slit opening along the length thereof.

A plurality of gripping members of the aforementioned type may be arranged in parallel with each other with the slit openings directed to the same side and connected together at the sides opposite to the slit openings to make it possible to bind a plurality of file sheets. A file sheet of the aforementioned type is held by each of the gripping members by inserting an edge portion of the file sheet into the slit opening of the gripping member. The file sheet is provided with one or more aligned ridges along the edge portion so that it is held in position with the ridges engaged with edge portion of the slit opening. The file sheet can be detached from the gripping member by moving it along the length of the gripping member through an open end of the gripping member.

The gripping member is of a thin walled structure and each member is manufactured separately. Then, a desired number of gripping members are connected together at the sides opposite to the slit openings by means of a connecting member such as an adhesive tape. Since the connecting member is of a flexible nature, the file sheets gripped by the gripping members can be turned over to have an access to a next file sheet. Thus, it is possible to access the recording discs stored in the file sheets as the discs are held in the file sheets. As compared with a conventional ring binders which use a plurality of binding rings, the aforementioned binder is compact in configuration and free from rust or stain.

SUMMARY OF THE INVENTION

It is an object of the present invention to provide a file sheet binder which is structurally improved so that a plurality of gripping members can be manufactured as an integral part.

Another object of the present invention is to provide a file sheet binder having a plurality of gripping members which can readily be manufactured as an integral part by a plastics material.

A further object of the present invention is to provide a file sheet binder which is less expensive to manufacture.

According to one aspect of the present invention, the above and other objects can be accomplished by a binder including a flat and elongated base plate and at least a pair of gripping members provided at one surface of the base plate. The paired gripping members comprise edges which are opposed to each other to form a slit therebetween so that a file sheet can be gripped at an edge portion by the edges forming the slit. The gripping members and the base plate are manufactured as an integral part from a plastics material.

In order to make it possible to form the gripping members integrally with the base plate, the gripping members are divided into a plurality pairs of axially aligned gripping segments. The plurality pairs of gripping segments are arranged with axial spacings therebetween. The base plate is formed between each pair of gripping segments with an opening of a rectangular configuration which is substantially equal in length to the gripping segment and in width to a spacing between the paired gripping segments. The opening is used for removing a core which will be used during manufacture of the binder for forming the interior configuration of the gripping segments.

According to another aspect of the present invention, the binder has a gripping arrangement which comprises at least a pair of rows of longitudinally aligned plurality of gripping members. Each of the gripping members comprises a wall perpendicular to the base plate and a resilient portion which is formed on the wall and has resiliency in a direction widthwise of the base plate. The gripping members in each row are aligned at the wall in the longitudinal direction of the base plate with the resilient portion directed toward the other row of the pair. The base plate is formed at a portion where each of the gripping members is located with an opening which is of a configuration corresponding to the resilient portion. The opening is used for removing a core which may be used for forming the resilient portion in molding the binder from a plastics material.

The file sheet binder of the above type may include a plurality of pairs of rows of the gripping members. Such pairs of rows of gripping members may be arranged in side-by-side relationship and can be manufactured by molding of a plastics material as an integral part. In this type of binder, the file sheet is inserted at its one edge portion between paired rows of gripping members to be gripped thereby. According to a further aspect of the present invention, the binder includes an elongated and flat base plate, and a wall portion substantially perpendicular to the wall portion and extending longitudinally substantially throughout the length of the wall portion. The wall portion is provided at one side thereof with a plurality of longitudinally spaced straps. Each of the straps is integral at one end with the wall portion and the base plate is formed at a location corresponding to each of the straps with an opening which is of a size and configuration corresponding to the strap to make it possible to remove a core for forming the strap.

A plurality of wall portions may be formed on the base plate with the straps arranged on the same sides of the wall portions to provide a bonder having a plurality of binding units. The binder of this type is designed to use with a file sheet having a plurality of apertures along an edge portion thereof. The straps may be inserted into one of the apertures formed in the file sheet from one to the other and then turned back through another aperture from the other side to the one side. Preferably, the strap is formed with a hook which can be used for engagement with the back side of the aperture through which the strap is inserted.

According to the first mentioned aspect of the present invention, it is preferable to use the binder with a file sheet which has ridges along an edge portion thereof. The edge portion having such ridges may then be inserted into the slit of the gripping member. The ridges are thus retained by the edges of the gripping member. The file sheet may be removed from the binder by moving it long the length of the gripping member.

According to the present invention, the base plate is formed with openings at locations where cores are used for forming gripping members, resilient portions or the straps. Therefore, it is possible to form the binder as an integral part by molding of a plastics material. After molding, cores can be removed through the openings. Thus, it is not necessary to form the gripping members and the base plate as in a conventional structure.

The present invention will now be described with reference to the accompanying drawings.

DESCRIPTION OF THE PREFERRED EMBODIMENT

Figure 1:
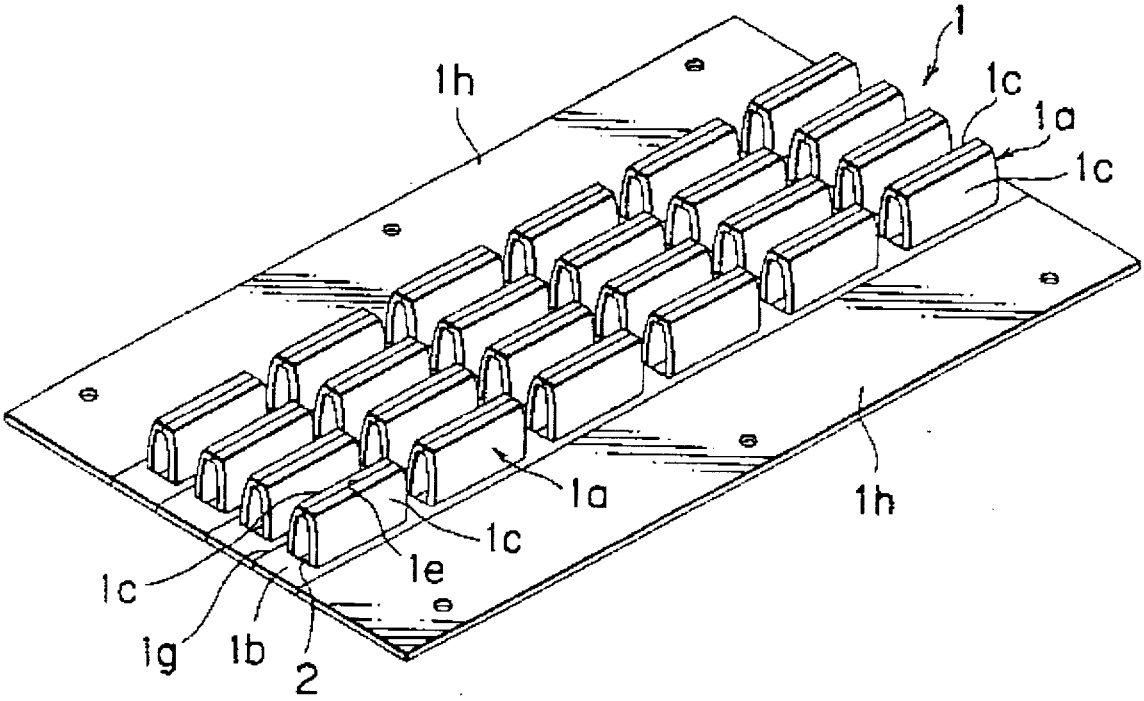
FIG. 1 is a perspective view of a file sheet binder in accordance with one embodiment of the present invention.
Figure 2:
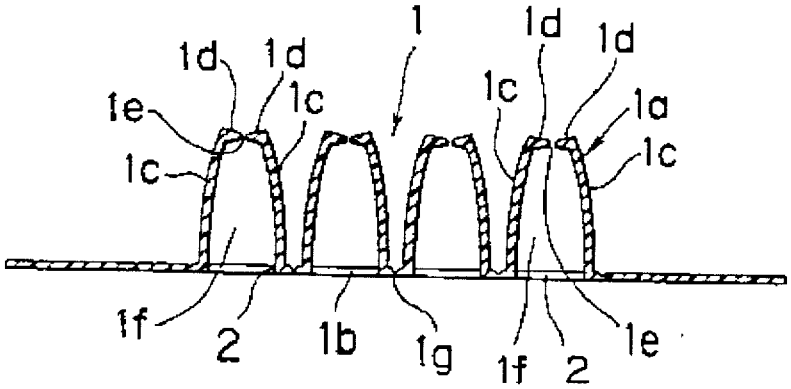
FIG. 2 is a cross-sectional view of the binder shown in FIG. 1.
Figure 3:
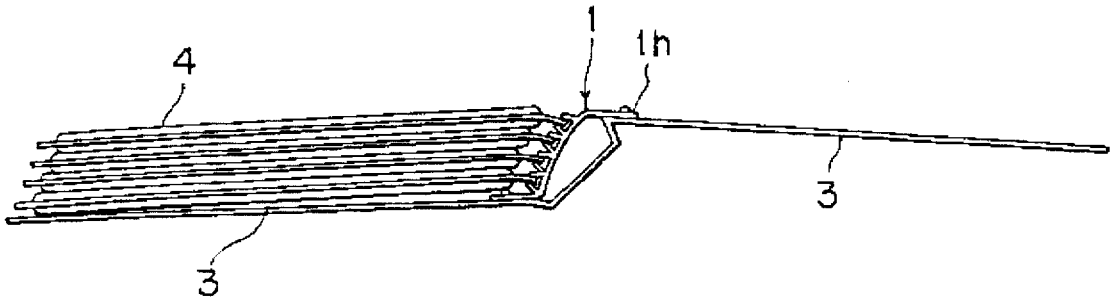
FIG. 3 is an end view of the binder shown in FIGS. 1 and 2 with a cover attached thereto and file sheets are held in position.

Referring now to the drawings, particularly to FIGS. 1 through 3, there is shown a file sheets binder 1 which includes four binding units each comprising a gripping section 1*a* and a base plate 1*b*. The binding units are arranged in side-by-side relationship. In each binding unit, the base plate 1*b* is of a flat configuration and has a plurality of gripping sections la formed at longitudinally spaced positions on one side of the base plate lb. Each of the gripping sections la is comprised of a pair of gripping members 1*c* which have edge portions 1*d* opposed to each other. The edge portions 1*d* of the paired gripping members 1*c* are opposed to each other to define an elongated slit 1*e* therebetween. Between the paired gripping members 1*c*, there is defined a groove if which is increased in width from the slit 1*e* toward inward direction. The base plate 1*b* in each binder unit is integrally connected with another base plate 1*b* of another binder unit through a thin hinge or connecting portion 1*g*.

The base plate 1*b* of the outermost binder unit is provided with a cover attaching tab 1*h* for attaching a binder cover as shown in FIG. 3.

In each binder unit, the base plate 1*b* is formed at locations corresponding to each gripping section 1*a* with an opening 2 which is adapted to take out a mold core. The opening 2 has a length extending throughout the length of the gripping member 1*c* in each gripping section 1*a* and a width which is substantially equal to the spacing between the paired gripping members 1*c*.

The binder 1 of this embodiment is formed integrally from a plastics material by adopting a conventional molding technology. During the molding, cores (not shown) are positioned at locations corresponding to the grooves 1*f* of the respective gripping sections 1*a*. After the molding, the cores are taken out without difficulty through the openings 2. It should therefore be noted that the binder of this embodiment can be manufactured more easily, and therefore is less expensive as compared with a conventional binder.

Figure 4:
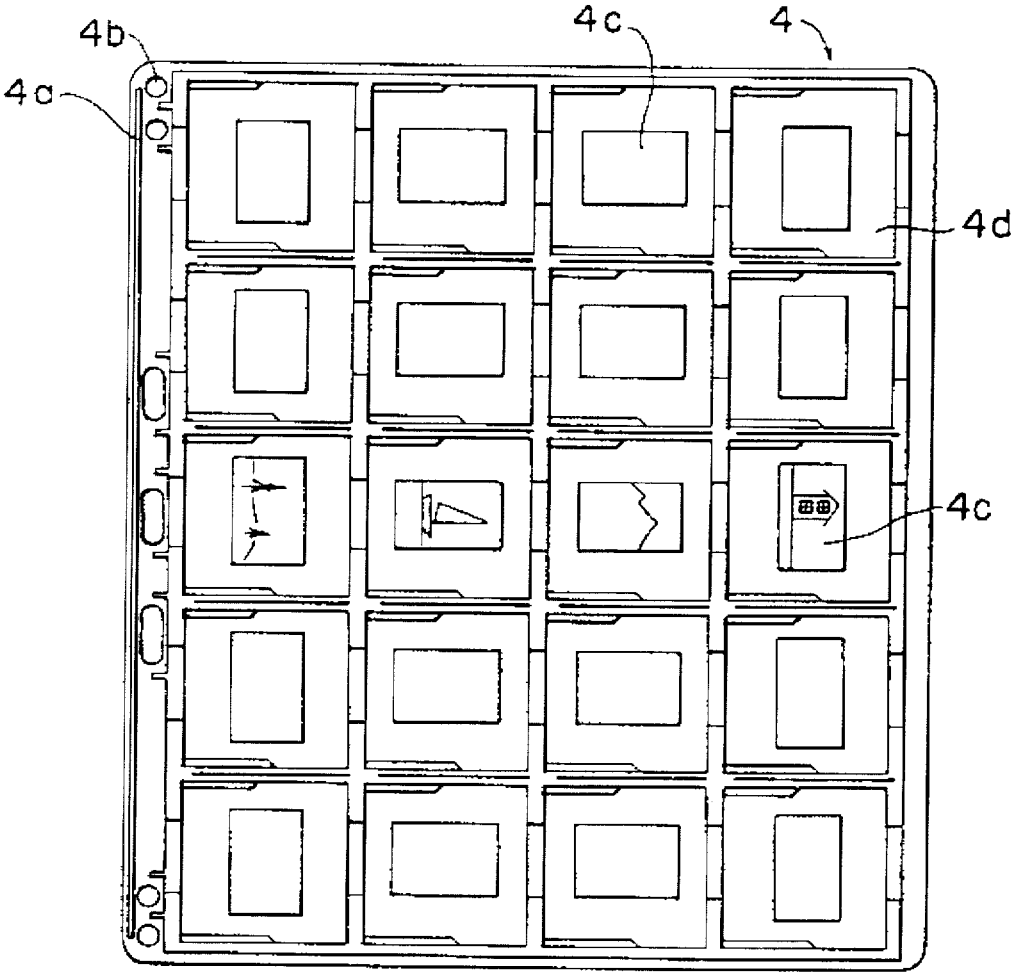
FIG. 4 is a plan view of an example of a file sheet which can be held by the binder of the present invention.

FIG. 4 shows a file sheet 4 which can be used with the binder 1 shown in FIGS. 1 through 3. The file sheet 4 has a plurality of storing sections 4*d* for storing photographic picture slides 4*c*. A plurality of binding apertures 4*b* are formed along one edge portion of the file sheet 4. The binding apertures 4*b* are provided for use with a conventional ring binder. The file sheet 4 is further formed along the edge portion adjacent to the apertures 4*b* with a ridge 4*a*. The ridge 4*a* may not necessarily be a continuous single ridge as shown in FIG. 4 but may be a plurality of longitudinally aligned ridge segments.

The file sheet 4 shown in FIG. 4 is filed in the binder 1 by inserting the edge portion having the ridge 4*a* into the slit 1*e*. The ridge 4*a* then engages the inner surfaces of the edge portions 1*d* forming the opening of the slit 1*e*. FIG. 3 shows a plurality of such file sheets filed in the binder 1. The hinge connections between the base plates 1*b* can be bent so that each file sheet 4 filed in the binder 1 can be turned over one by one to access picture slides 4*c* stored in each file sheet 4.

Figure 5:
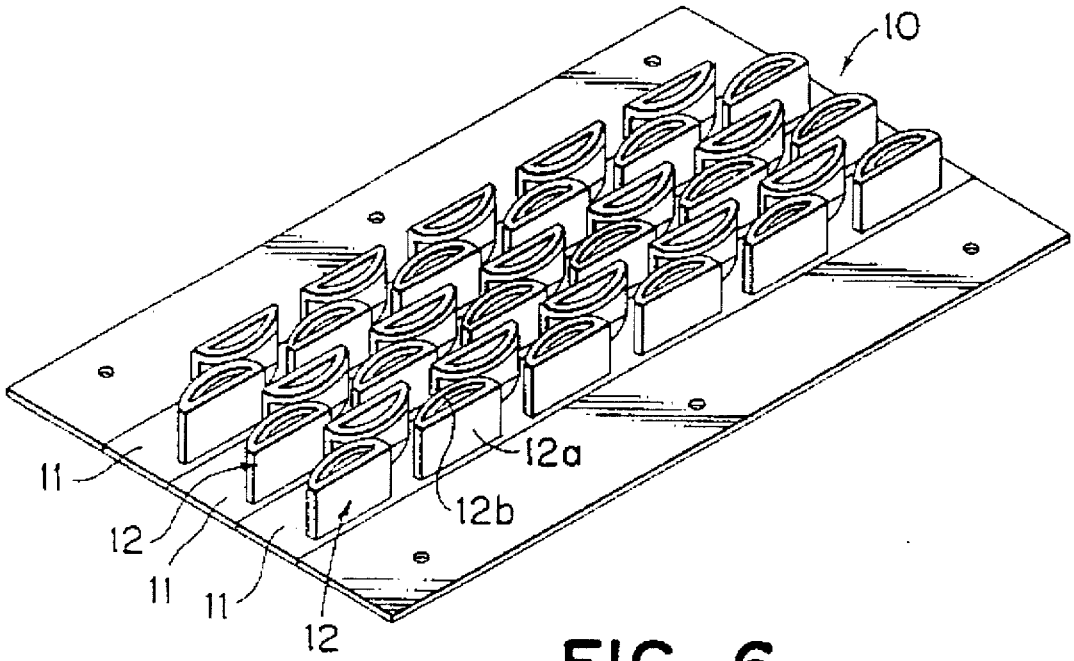
FIG. 5 is a perspective view of a file sheet binder in accordance with another embodiment of the present invention.
Figure 6:
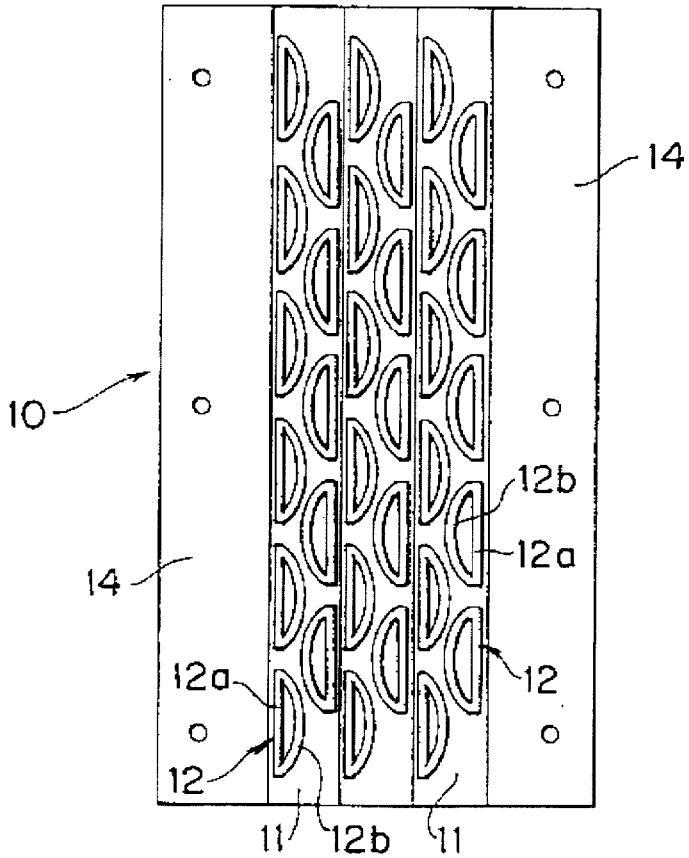
FIG. 6 is a plan view of the binder shown in FIG. 5.

FIGS. 5 through 8 show another embodiment of the present invention. Referring to FIGS. 5 and 6, there is shown a binder 10 which includes a plurality of binder units each comprised of an elongated flat base plate 11 and a pair of rows of gripping members 12 which are integrally formed on one side of the base plate 11. In each row, a plurality of gripping members 12 are arranged in a longitudinally aligned relationship. Each of the gripping members 12 has a flat wall 12*a* which is substantially perpendicular to the base plate 11.

Figure 7:
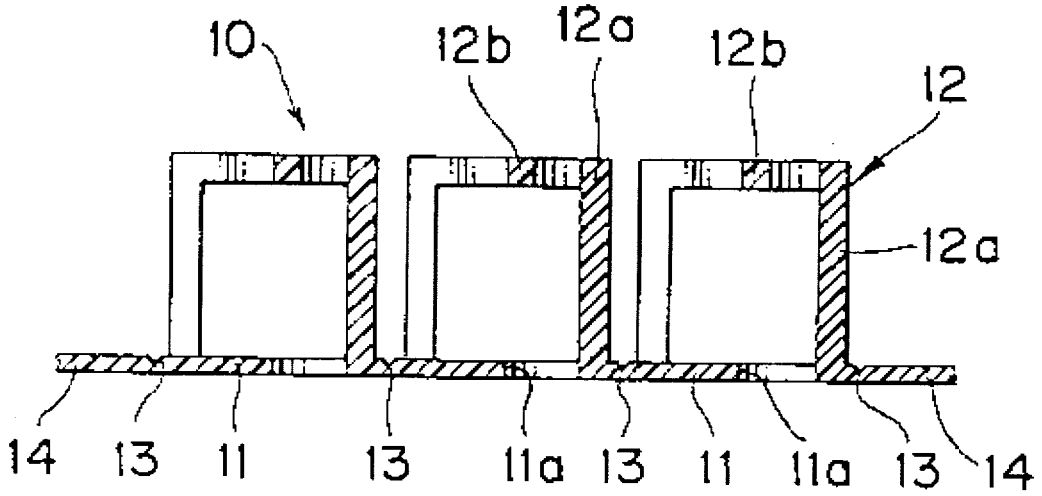
FIG. 7 is a cross-sectional view of the binder shown in FIGS. 5 and 6.
Figure 8:
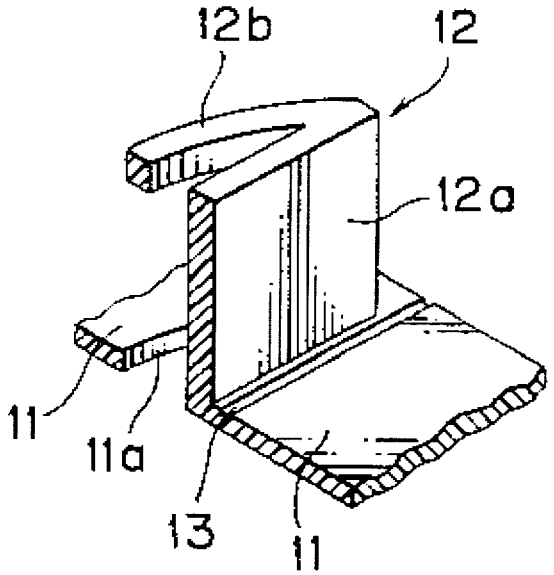
FIG. 8 is a fragmentary sectioned perspective view of the binder shown in FIGS. 1 through 7.

The wall 12*a* of the gripping member 12 in one row is provided at a side facing to the other row of the gripping members with a resilient member 12*b* which has a resiliency in the widthwise direction of the base plate 11. In the illustrated embodiment, the resilient member 12*b* is of an arcuate shape with the opposite ends integrally connected with the upper portion of the wall 12*a*. FIGS. 7 and 8 show the connection between the wall 12*a* and the resilient member 12*b*. According to the purpose of the present invention, the resilient member 12*b* may not necessarily be connected at the opposite ends to the wall 12*a* but only one of the ends may be integrally connected with the wall 12*a* with the other end left free.

Referring to FIGS. 5 and 6, it will be noted that in each of the binder units, the two rows of the gripping members are arranged in a staggered relationship along the base plate 11. The base plate 11 of the outermost binder unit is integrally formed with a cover attaching tab 14.

As shown in FIGS. 7 and 8, the base plates 11 in a pair of adjacent binder units are connected together by means of a thin walled hinge or connecting member 13. The base plate 11 is further formed at a location corresponding to the resilient member 12b with an opening 11a of an arcuate shape which is adapted for taking out a core which will be used for forming the resilient member 12b. Therefore, as in the previous embodiment, the binder 10 of this embodiment can be manufactured integrally by molding a plastics material.

The binder 10 is used to file one or more file sheets such as the file sheets 4 shown in FIG. 4 by inserting the file sheet 4 at the edge portion having the ridge 4a between the paired rows of the gripping members 12. The ridge 4a of the file sheet 4 is then engaged with inner sides of the resilient members 12b of the gripping members 12.

Figure 9:
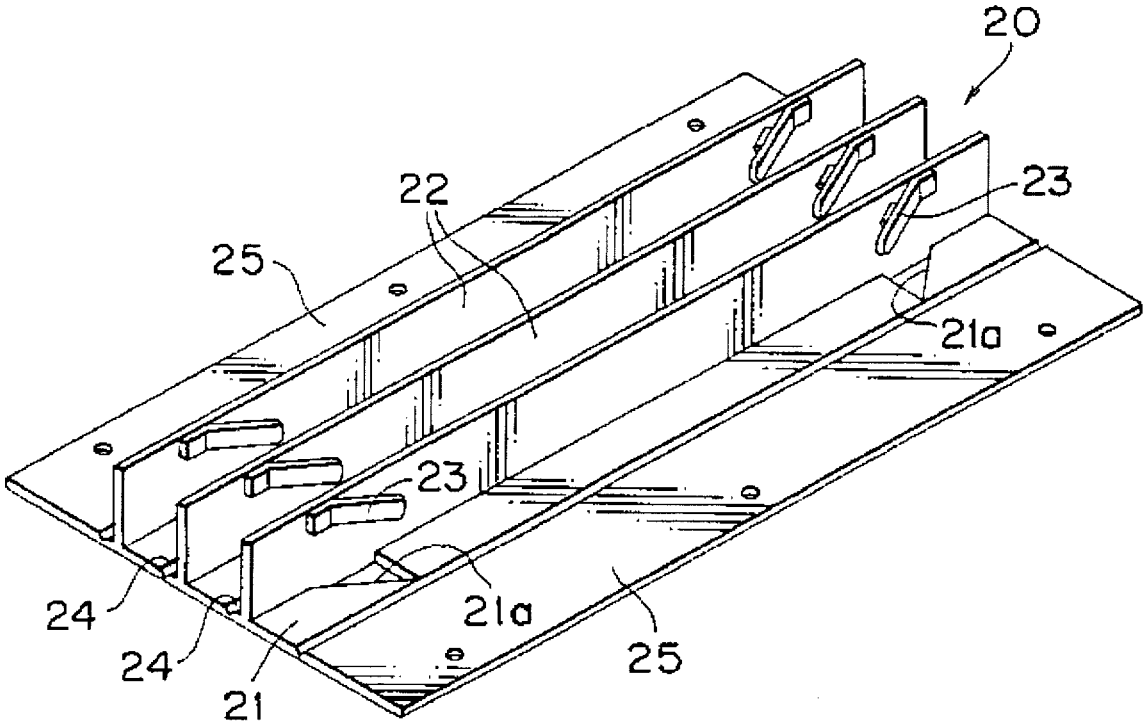
FIG. 9 is a perspective view of a file sheet binder in accordance with a further embodiment of the present invention.
Figure 10:
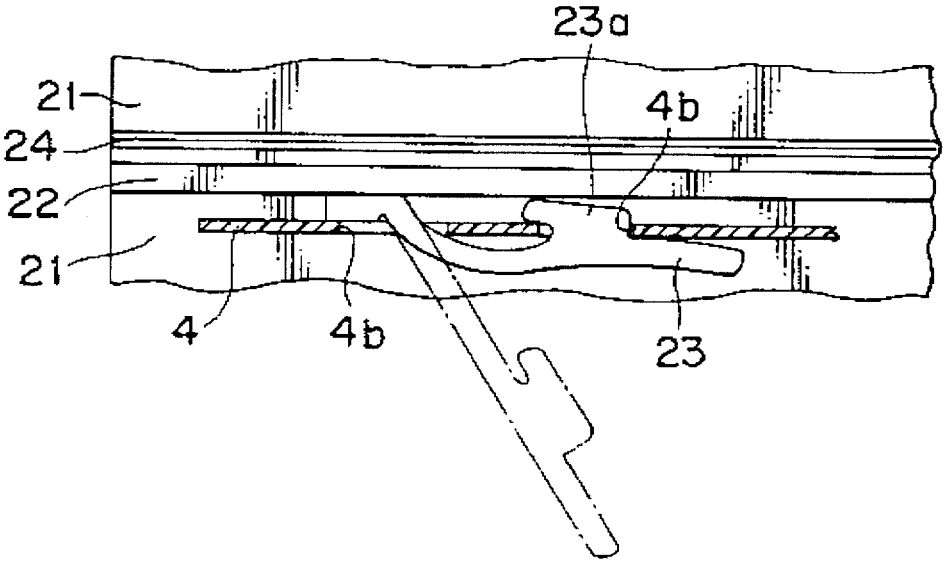
FIG. 10 is a fragmentary plan view of the binder shown in FIG. 9.
Figure 11:
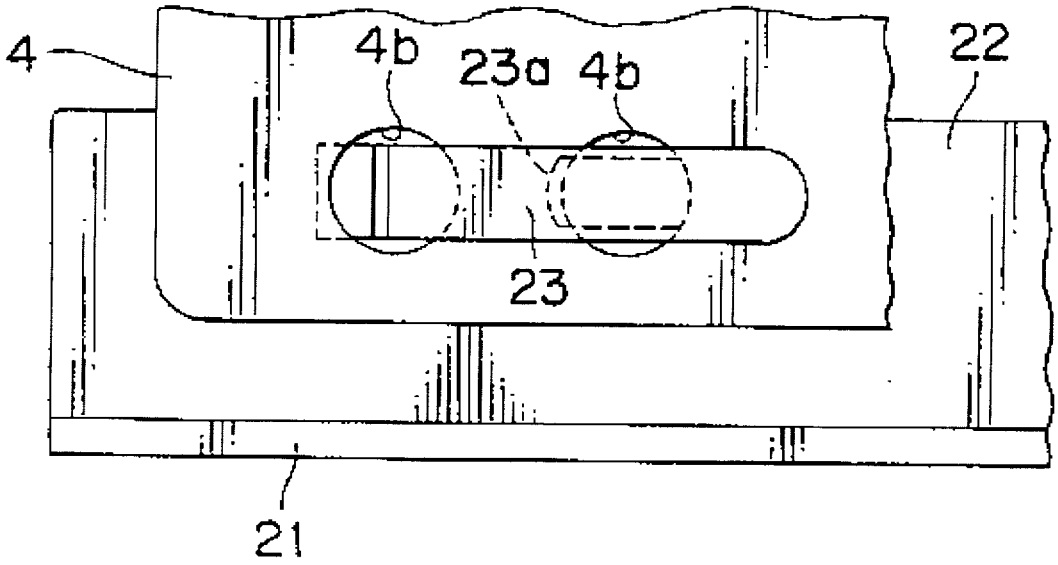
FIG. 11 is a side view of the binder shown in FIGS. 9 and 10.

Referring now to FIGS. 9 through 11, there is shown a binder 20 in accordance with a further embodiment of the present invention. Referring to FIG. 9, the binder 20 includes a plurality of binder units each comprising a flat, elongated base plate 21 and a flat wall 22 which is substantially perpendicular to the base plate 21. The wall 22 is formed at one side with a pair of resilient binding straps 23 which are integral with the wall 22. As shown in FIG. 10, each of the binding straps 23 is integrally connected at one end with the other end left free. Each binding strap 23 is formed adjacent to the free end with a hook 23a.

Referring to FIG. 9, the base plate 21 of each binder unit is formed at locations corresponding to the binding straps 23 with openings 21a which correspond in shape to the configuration of the straps 23. The openings 21a are adapted for taking out cores which will be used for forming the straps 23 during molding process. The base plates 21 in adjacent two binding units are connected together by means of a thin walled hinge or connecting member 24. The base plate 21 for each outermost binding unit is formed integrally with a cover attaching tab 25. The binder 20 of this embodiment can also be formed integrally from a plastics material by a conventional plastic molding process.

Referring to FIGS. 10 and 11, it will be noted that the binder 20 of this embodiment is used to file a file sheet, such as the file sheet 4 shown in FIG. 4 utilizing the binding apertures 4b in the file sheet 4. The strap 23 is inserted into one of the apertures 4b form one side, for example, from the back side of the file sheet 4 to pass to the other side, for example, to the front side, and the hook 23a is engaged with another adjacent aperture 4b.

Figure 12:
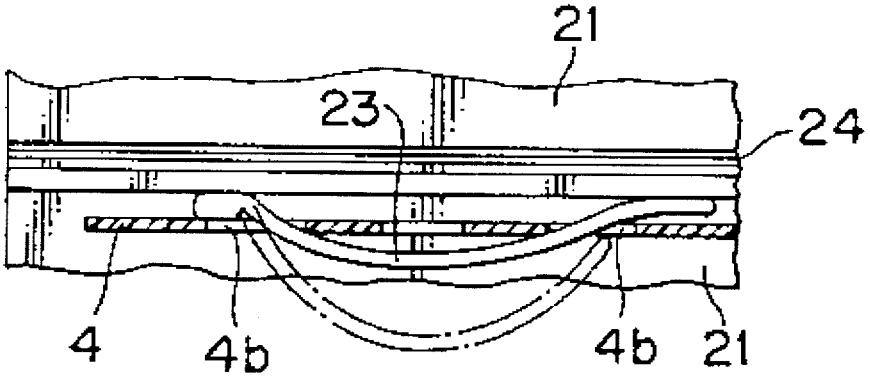
FIG. 12 is a plan view showing a modification of the binder shown in FIG. 9.

In FIG. 12, there is shown a modification of the binder shown in FIGS. 9 through 11. In this embodiment, the strap 23 is not formed with a hook 23a. The strap 23 is inserted from one side of the file sheet 4 into one of the apertures 4b to the other side and turned back from the other side to the one side through the adjacent aperture 4b. In other respects, the structure of the binder is the same as the binder 20 shown in FIGS. 9 through 11 so that corresponding parts are shown by the same reference numerals and detailed description will be omitted.

The invention has thus been shown and described with reference to the accompanying drawings, however, it should be noted that the invention is in no way limited to the details of the illustrated structures but changes and modifications may be made without departing from the scope of the appended claims.

What is claimed is:

1. A file sheet binder including at least one binding unit which comprises a flat, elongated base plate and at least one gripping section including a pair of gripping members provided at one surface of the base plate, the paired gripping members having edges which are opposed to each other to form a slit therebetween so that a file sheet can be gripped at an edge portion by the edges forming the slit, an opening formed in said base plate between said paired gripping members, the gripping members and the base plate being manufactured as an integral part by molding a plastics material, said opening being adapted for removing a core which is used in molding process for defining a space between said paired gripping members.

2. A file sheet in accordance with claim 1 which includes a plurality of said binding units, the base plate of on binding unit being connected through a thin walled connecting member with the base plate of an adjacent binding unit.

3. A file sheet in accordance with claim 1 wherein said gripping members define a groove having a width which increases from said slit toward inward direction.

4. A file sheet in accordance with claim 1 wherein each binding unit includes a plurality of gripping sections which are longitudinally spaced apart from each other.

5. A file sheet binder including at least one binding unit which comprises a pair of rows of longitudinally aligned plurality of gripping members, each of the gripping members in each row comprising a wall substantially perpendicular to the base plate and a resilient portion which is formed on the wall at a side facing to the other row of the gripping members and has a resiliency in a direction of width of the base plate, said gripping members in each row being aligned at the wall in the longitudinal direction of the base plate, said base plate being formed at a portion where each of the gripping members is located with an opening which is of a configuration corresponding to the resilient portion, the gripping members and the base plate being manufactured as an integral part by molding a plastics material, said opening being adapted for removing a core which is used in molding process for defining a space between said paired gripping members.

6. A file sheet binder in accordance with claim 5 in which said resilient portion of said gripping member is of an arcuate configuration having at least one end integrally connected with said wall.

7. A file sheet binder in accordance with claim 6 in which said resilient portion of said gripping member is connected at the opposite ends with the wall.

8. A file sheet binder in accordance with claim 5 in which said gripping members in the paired rows are arranged in a staggered relationship.

9. A file sheet in accordance with claim 5 which includes a plurality of said binding units, the base plate of on binding unit being connected through a thin walled connecting member with the base plate of an adjacent binding unit.

10. A file sheet binder including at least one binding unit comprising an elongated and flat base plate, and a wall portion substantially perpendicular to the wall portion and extending longitudinally substantially throughout the length of the wall portion, the wall portion being provided at one side thereof with a plurality of longitudinally spaced straps each being attached at one end to said wall portion, the base plate being formed at a location corresponding to each of the straps with an opening which is of a size and configuration corresponding to the strap to make it possible to remove a core for forming the strap.

11. A file sheet binder in accordance with claim 10 in which a plurality of said binding units are provided, the base plate of on binding unit being connected through a thin walled connecting member with the base plate of an adjacent binding unit.

12. A file sheet binder in accordance with claim 10 in which each of said straps is formed with a hook device for engagement with an aperture formed in said file sheet.

* * * * *